US008939874B2

(12) United States Patent
Mizrachy

(10) Patent No.: US 8,939,874 B2
(45) Date of Patent: Jan. 27, 2015

(54) PHYSICAL WORK-OUT DEVICE WITH ADJUSTABLE ELASTIC BANDS

(76) Inventor: Henn Mizrachy, Modi'in (IL)

( * ) Notice: Subject to any disclaimer, the term of this patent is extended or adjusted under 35 U.S.C. 154(b) by 384 days.

(21) Appl. No.: 13/319,995

(22) PCT Filed: May 4, 2010

(86) PCT No.: PCT/IL2010/000356

§ 371 (c)(1),
(2), (4) Date: Nov. 10, 2011

(87) PCT Pub. No.: WO2010/131243

PCT Pub. Date: Nov. 18, 2010

(65) Prior Publication Data

US 2012/0058864 A1 Mar. 8, 2012

(30) Foreign Application Priority Data

May 10, 2009 (IL) ..... 198660

(51) Int. Cl.

| | |
|---|---|
| ***A63B 21/02*** | (2006.01) |
| ***A63B 21/055*** | (2006.01) |
| ***A63B 21/00*** | (2006.01) |
| ***A63B 21/16*** | (2006.01) |

(52) U.S. Cl.

CPC ..... *A63B 21/0552* (2013.01); *A63B 21/1415* (2013.01); *A63B 21/16* (2013.01); *A63B 21/00069* (2013.01)

USPC ..... 482/124

(58) Field of Classification Search

USPC ..... 482/120–127

See application file for complete search history.

(56) References Cited

U.S. PATENT DOCUMENTS

| | | | | |
|---|---|---|---|---|
| 5,618,249 | A * | 4/1997 | Marshall | 482/127 |
| 5,792,034 | A * | 8/1998 | Kozlovsky | 482/124 |
| 5,795,274 | A * | 8/1998 | Kasbohm | 482/115 |
| 6,280,365 | B1 * | 8/2001 | Weber et al. | 482/124 |
| 2003/0153441 | A1 * | 8/2003 | Berns et al. | 482/128 |
| 2004/0053755 | A1 * | 3/2004 | Wilkinson | 482/124 |
| 2009/0305827 | A1 * | 12/2009 | Webb et al. | 473/458 |
| 2010/0062915 | A1 * | 3/2010 | LaSala | 482/127 |

* cited by examiner

*Primary Examiner* — Loan H Thanh
*Assistant Examiner* — Andrew S Lo
(74) *Attorney, Agent, or Firm* — Donn K. Harms

(57) ABSTRACT

A physical work-out apparatus comprised of a mechanism for shortening elastic bands, and one or more elastic bands that are integrated into the mechanism in such a way that enables a user to shorten or lengthen the elastic bands. The apparatus can be integrated and attached to a harness worn on the user's back and chest. The mechanism enables the user to shorten or lengthen, according to need, the elastic band or bands.

11 Claims, 13 Drawing Sheets

PHYSICAL WORK-OUT DEVICE WITH ADJUSTABLE ELASTIC BANDS

BACKGROUND OF THE INVENTION

1. Field of the Invention

This application is based on PCT/IL2010/000356 with an international filing date of May 4, 2010 which claims priority to Israeli Patent Application Number 198660 having a filing date of May 10, 2009.

The present invention refers to a physical work-out device that is based on elastic bands of adjustable length. Specifically, the device includes a mechanism that enables the user to change the length of the elastic bands according to need.

2. Prior Art

Strength training and general work out practices are part of many individual's daily routines and life styles. Strength training, also known as resistance training, uses a resistance to the force of muscular contraction to build muscle strength. Specific types of strength training use either elastic or hydraulic tension to provide this resistance. Many strength-training apparatuses exist employing elastic bands as an elastic resistance means. Typically, the exertion required by the user to stretch the elastic band constitutes the work-out component. The ends of elastic bands are customarily equipped with handles so as to enable the user to grip the end of the band in his or her hand or insert it over his or her foot. It is also customary that users and fitness centers have a variety of elastic bands of various lengths. Each elastic band offers a different degree of resistance that is determined by its length, and each elastic band is thus intended for a different level of work-out.

However, elastic work-out bands that are customarily used today have two main problems. First, if a user desires to employ a wide range of resistance, a plurality of elastic bands of different lengths is needed, requiring the user to purchase many such bands and allocate a large storage space for them. Second, elastic bands only provide a means to simulate pulling or lifting, but not pressing.

As such, there is a continuing unmet need for an improved work out device employing elastic band resistance means.

SUMMARY OF THE INVENTION

The device herein disclosed and described provides a solution to the shortcomings in prior art and achieves the above noted goals through the provision of a physical fitness device employing elastic band resistance means. The device generally includes one or a plurality of elastic bands communicating with a means to shorten and lengthen the elastic bands, as needed to define different resistance. In use, the device is engaged to the user via a harness or the like to which the shortening/lengthening means and elastic bands are attached, and which can be worn as a kind of vest. It is within the scope and intention of the invention that the means to shorten or lengthen the elastic bands enable the user to shorten or lengthen the elastic bands quickly and easily, according to need.

In general, the means to shorten or lengthen the bands is a wheel or screw type mechanism providing a central cylinder or hub which can be rotated to wind the bands about themselves and the cylinder to effectively shorten the length of band extending from the cylinder.

Each of the elastic band's distal ends are preferably equipped with a loop to which a strap may be attached and is designed to serve as a handle. The device may include one or more elastic bands. Further, it is additionally preferred that the shortening/lengthening mechanism and the elastic bands can be disengaged from the harness to allow the bands to be used for work-outs in other situations in which they are not stretched from the user's back towards his or her chest.

Utility and advantages are provided to the user employing the device of the present invention. Among these advantages is the fact that the user needs only one or a few sets of elastic bands and can use them in different lengths therefor providing the equivalent to having several elastic bands. In addition, employing the device worn on the back, enables the user to perform work-out movements in many more angles, especially pressing forward, upward, and to the sides.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of the invention to provide an improved elastic band resistance fitness device.

It is another object of the invention to provide a fitness device employing elastic band resistance wherein the length of the elastic band can be shortened or lengthen to define a plurality of different resistance.

BRIEF DESCRIPTION OF DRAWING FIGURES

FIG. 1*a* depicts a front view of a preferred mode of the device.

FIG. 1*b* depicts a side perspective view of the preferred mode of the device of FIG. 1*a*.

Figure 13A:
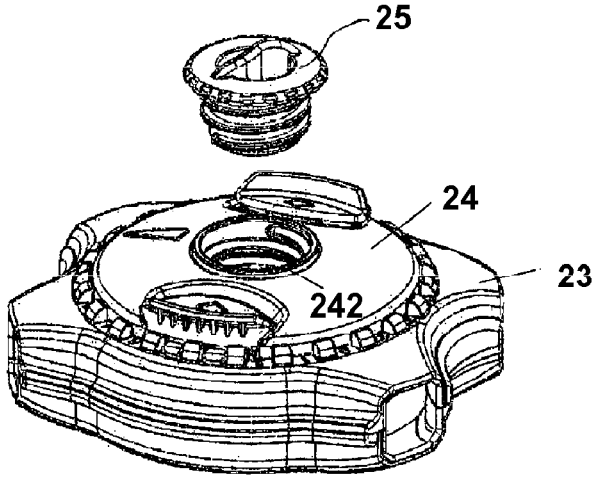

FIG. 13*a* depicts the shortening/lengthening mechanism and tightening screw prior to engagement.

Figure 13B:
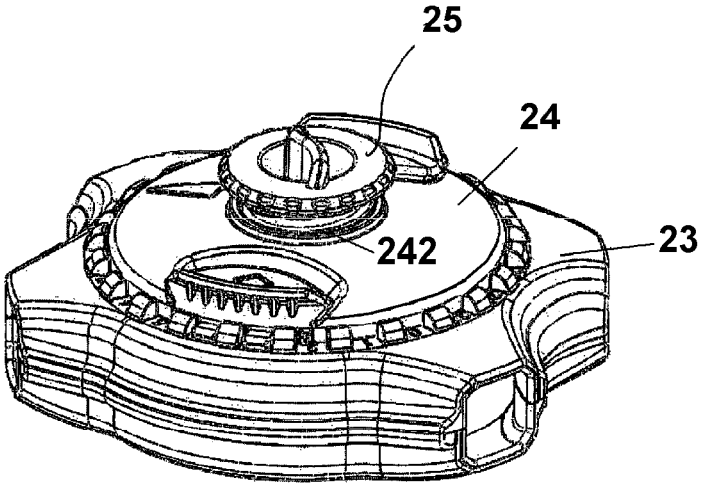

FIG. 13*b* depicts the shortening/lengthening mechanism and tightening screw in the engaged position.

Figure 14:
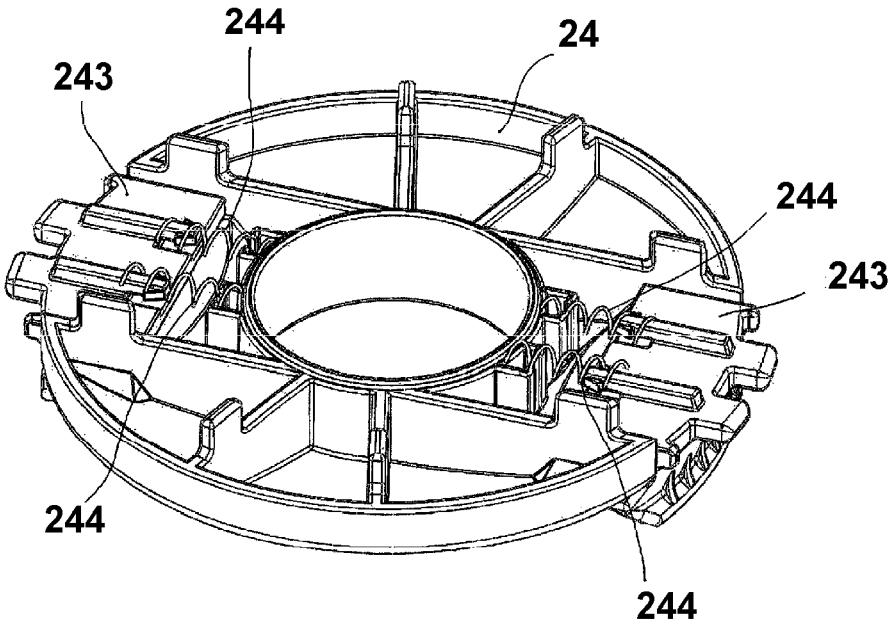

FIG. 14 shows a bottom view of the cover.

Figure 15:
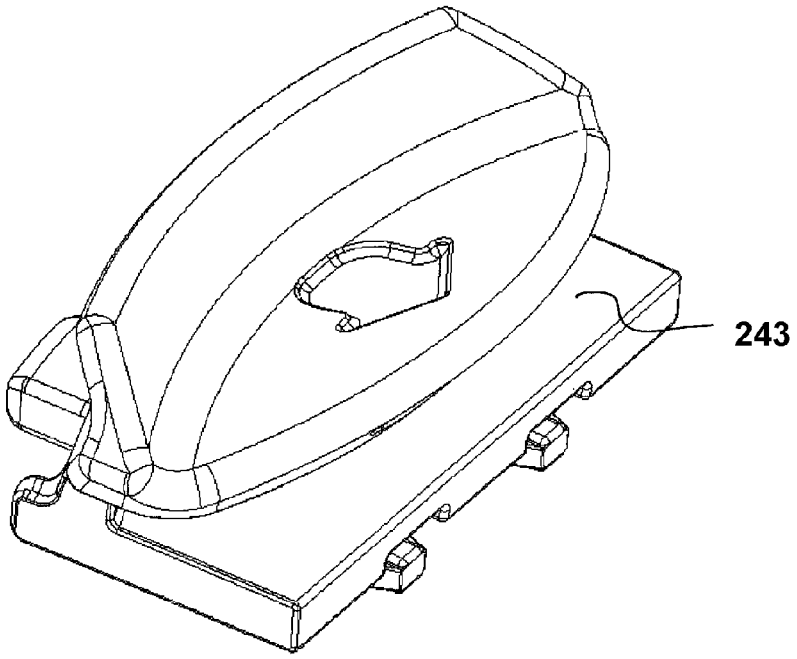

FIG. 15 depicts a perspective view of the knob component.

Figure 16:
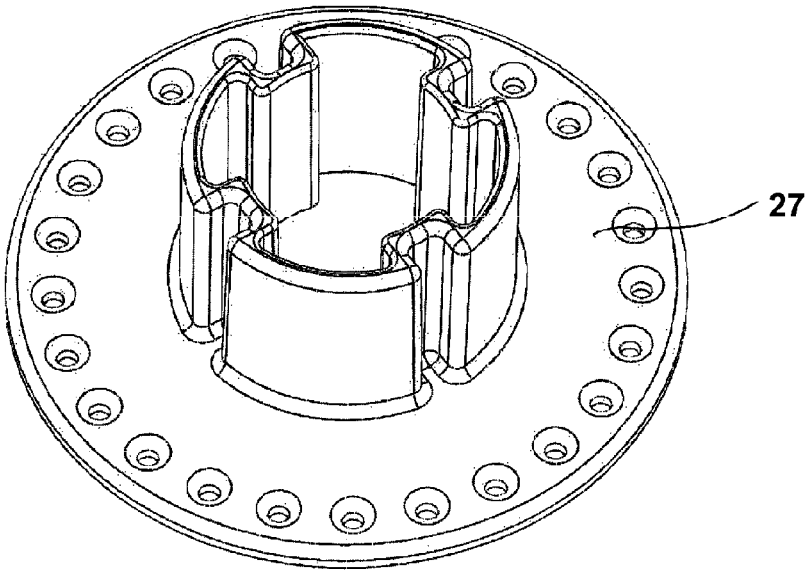

FIG. 16 depicts the attaching means.

Figure 17A:
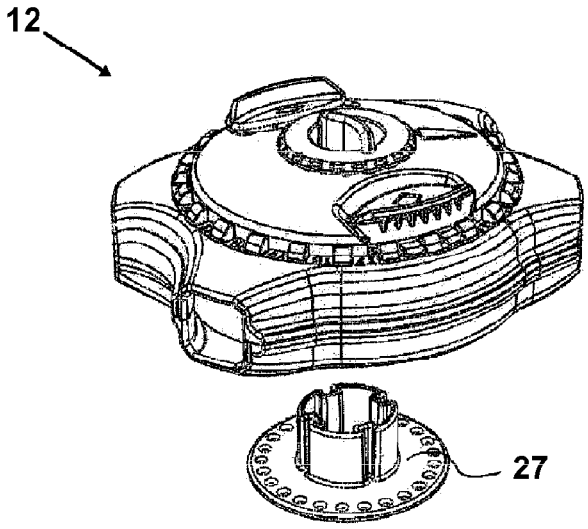

FIG. 17*a* depicts the attaching means prior to engagement to the harness.

Figure 17B:
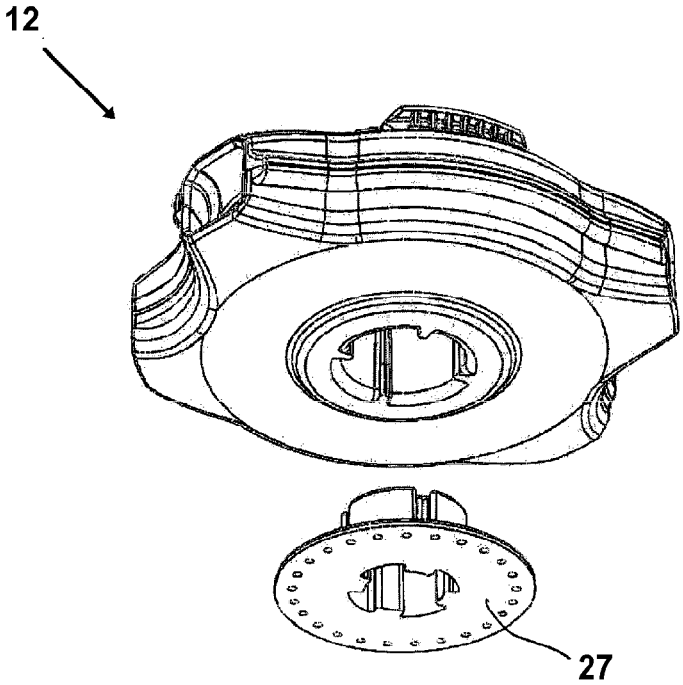

FIG. 17*b* shows a bottom view of FIG. 17*a*.

Figure 18A:
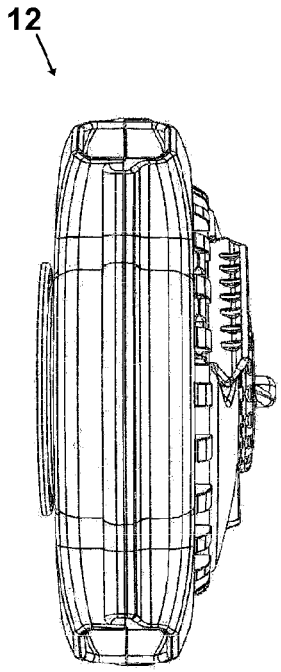

FIG. 18*a* depicts a view of the completed assembly of the mechanism.

Figure 18B:
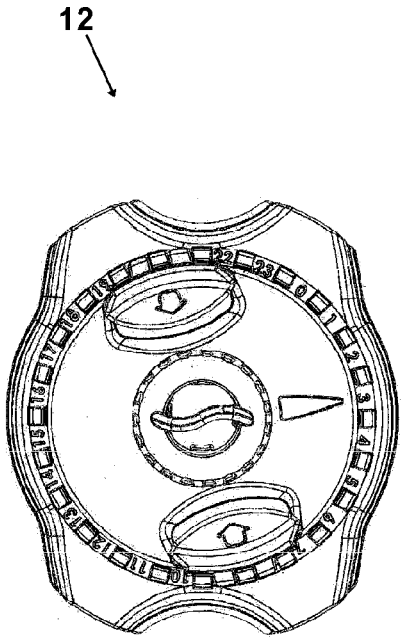

FIG. 18*b* depicts another view of the completed assembly of the mechanism.

Figure 18C:
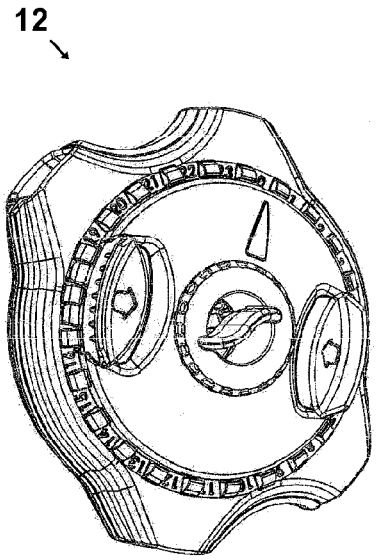

FIG. 18*c* depicts yet another view of the completed assembly of the mechanism.

Figure 18D:
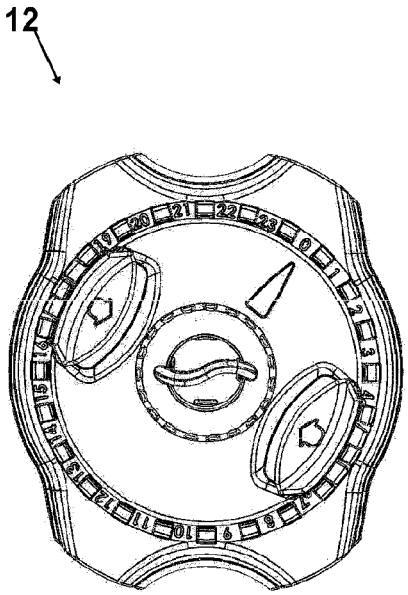

FIG. 18*d* depicts still yet another view of the completed assembly of the mechanism.

Figure 18E:
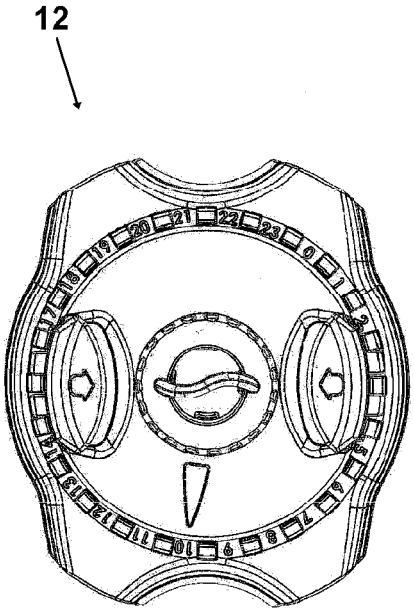

FIG. 18*e* depicts still yet another view of the completed assembly of the mechanism.

Figure 18F:
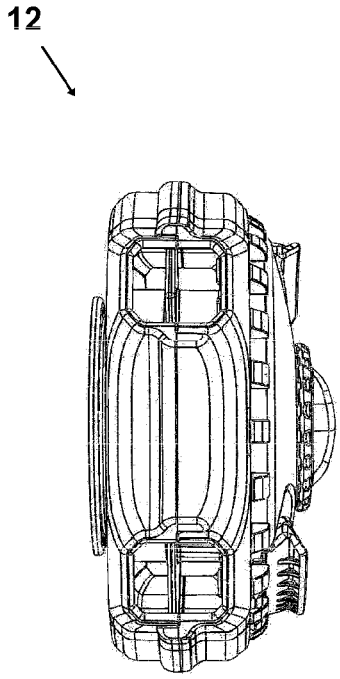

FIG. 18*f* depicts still yet another view of the completed assembly of the mechanism.

Figure 18G:
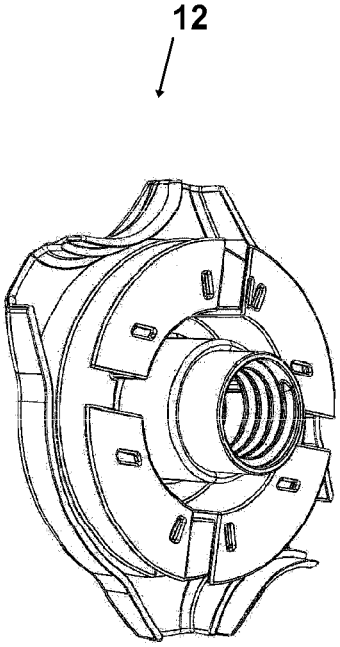

FIG. 18*g* depicts yet another view of the completed assembly of the mechanism.

Figure 19:
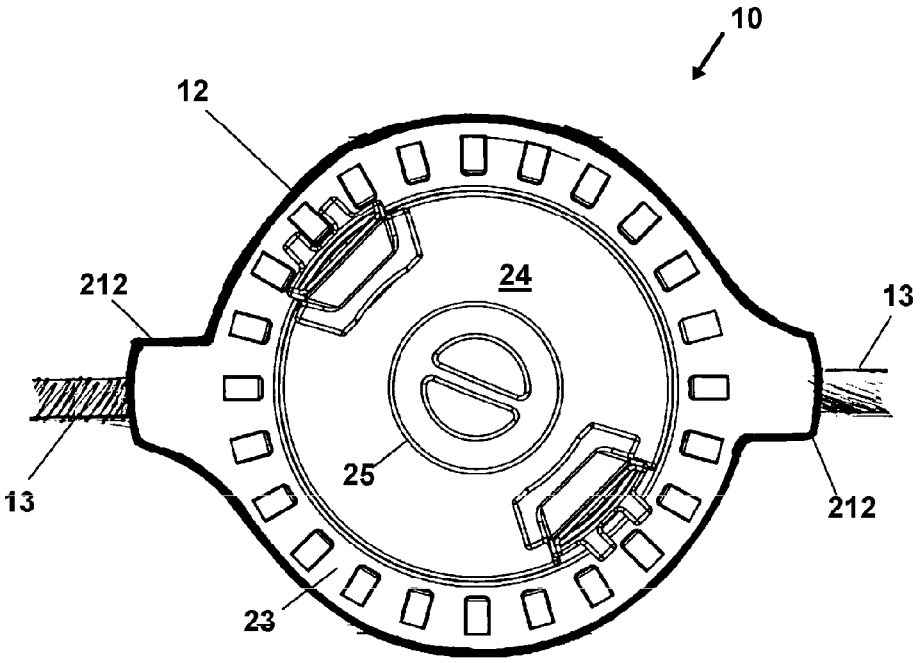

FIG. 19 shows a top view of still yet another mode of the device employing a single elastic band integrated into the mechanism of the device.

Figure 20:
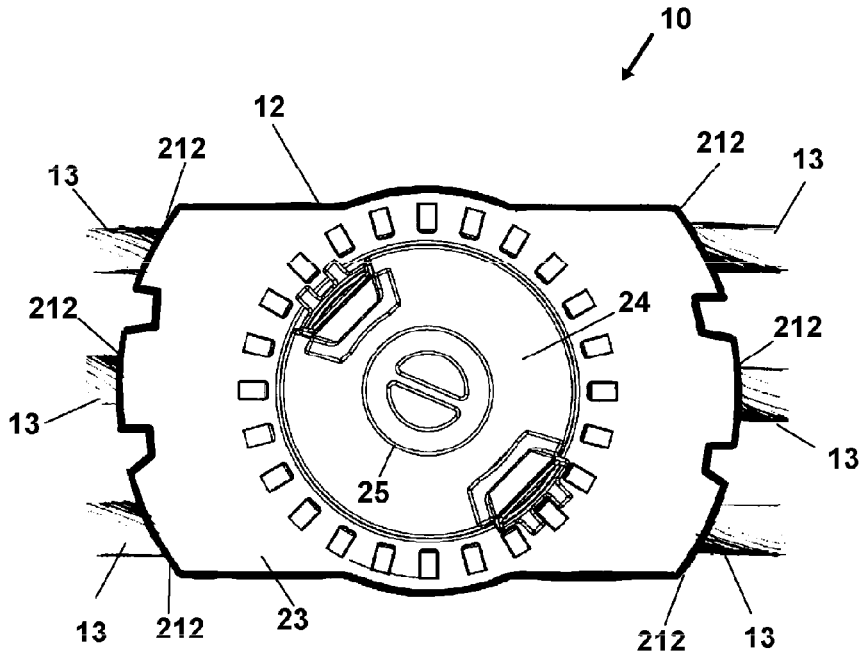

FIG. 20 shows a top view of another mode of the device employing three elastic band integrated into the mechanism of the device.

DETAILED DESCRIPTION OF THE PREFERRED EMBODIMENTS OF THE INVENTION

Figure 1A:
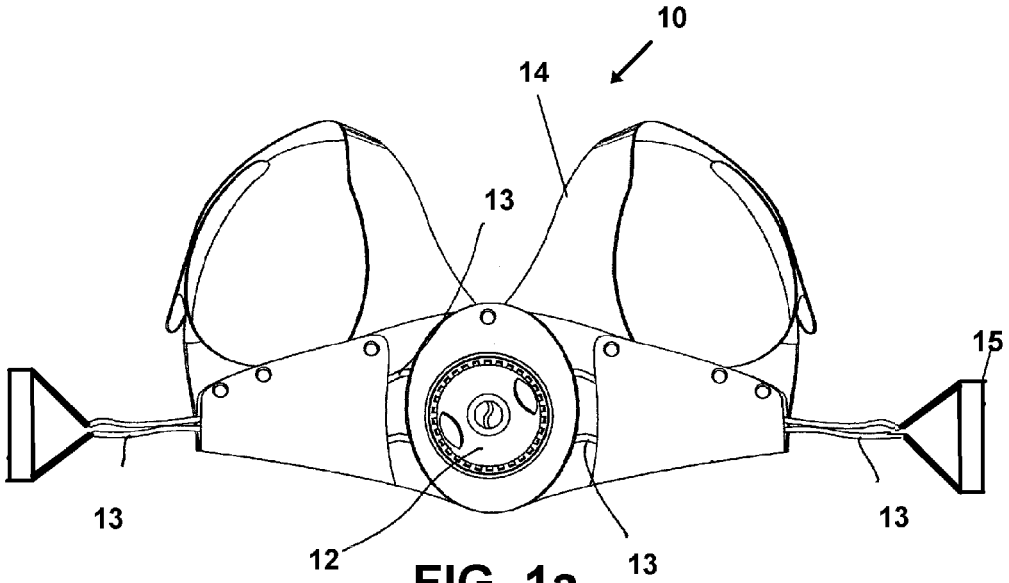

Now referring to drawings in FIGS. 1-20, wherein similar components are identified by like reference numerals, there is seen in FIG. 1*a* the physical fitness device 10 that is based on elastic bands. The device 10 consists of a mechanism 12, that shortens or lengthens the elastic bands, and one or a plurality elastic bands 13.

In accordance with the particularly preferred mode of the present invention, the device 10 may also include a harness 14 to which the mechanism 12 and elastic bands 13 are operatively attached therein. Such a harness 14 allows the device 10 to be worn by a user as a kind of vest thereby allowing the user himself to be the mount for the device 10 in an elevated as-used position. The employment of the harness 14 also allows the user to move about and exercise with the device 10 should they so wish.

The elastic bands 13 are integrated into the mechanism 12 in such a way that enables the user to shorten or lengthen them, according to need. It must be noted that the description and depiction set forth below depict one particularly preferred mode of the mechanism 12 providing a means to shorten or lengthen an elastic band. However, those skilled in the art will appreciate various other means to shorten or lengthen an elastic band as is within the intended scope of the invention and are anticipated.

Figure 1B:
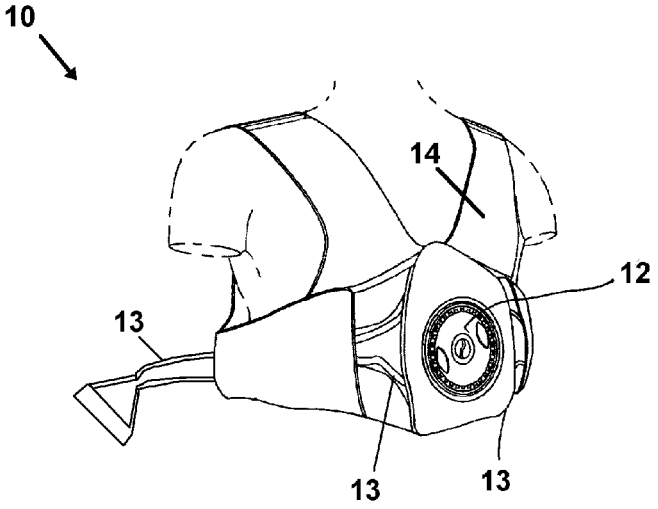

In FIG. 1*b*, the device 10 with harness 14 in the as-used position is shown. A major component of the device 10, subject of the present invention, is the mechanism 12, which provides the user with a means shorten or lengthen the elastic bands 13 providing variable resistance as needed. The main objective of the mechanism 12 is to enable the user to shorten or lengthen the elastic bands 13 of the device 10 quickly and easily, according to need for a particular exercise and/or their physical size and current conditioning.

Figure 2:
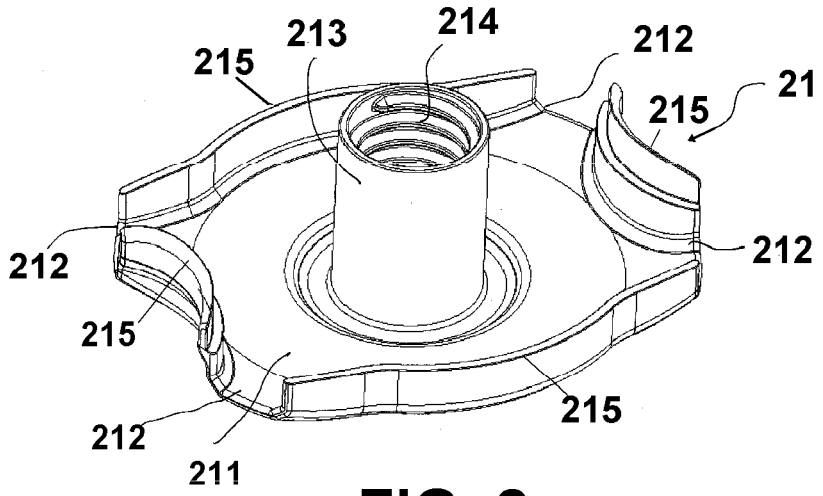
FIG. 2 shows a view of the base component of the device.

The mechanism 12 comprises operatively the following components: a base 21, an inner wheel 22, an upper frame 23, a cover 24, and a tightening screw 25. FIG. 2 depicts the base 21 which forms a bottom part of the mechanism 12 when worn in the as-used position using the vest or when situated upright with the base 21 on a surface if so employed.

As depicted, the base 21 is shaped like an open box with a generally planar bottom 211 surface from which extends a sidewall around four substantially perpendicular sides. A plurality of apertures adjacent to four corner areas of the base serve as openings 212 for the operative communication of the elastic bands 13. These bands 13 that are operatively integrated into the mechanism 13 as shown in later figures.

A substantially perpendicular, substantially hollow cylinder 213 with an internal thread 214 is engaged to a central area of the bottom 211, or base 21. Central portions of the sides of the base 21 are shaped to form an area which is generally convex/concave 215, thus forming a kind of imaginary circle. The reason for this will be evident upon further description of the mechanism in general and the inner wheel 22 in particular.

Figure 3:
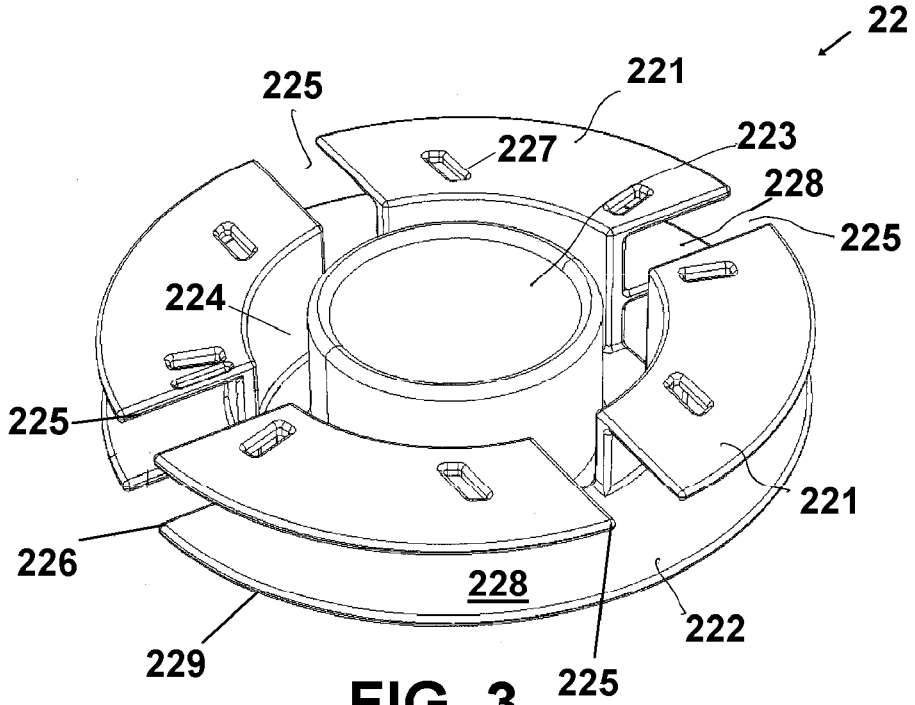
FIG. 3 depicts a view of the internal wheel of the shortening/lengthening mechanism of the device.

FIG. 3 depicts the inner wheel 22. The wheel 22 has a substantially perpendicular and preferably hollow cylinder 223 with two horizontal protruding discs shown as an upper disc 221 and a bottom disc 222. In use, the hollow cylinder 223 is engaged over the cylinder 213 extending from the base 21. The circumferential space 224 between the discs 221, 222 and the perpendicular cylinder 223 forms generally circular inner track. The upper disc 221 has four notches formed by cut-outs 225 at substantially 90 degree intervals, which provide a means for a division of the disc into four quarters. The bottom disc 222 has two cut-outs 226 positioned at 180 degree intervals, which correspond to two of the top disc cut-outs 225 thereby dividing the bottom disc into two halves.

A steering hole 227 is located at the edge of each of the four quarters of the top disc 221. The space between the upper disc 221 and the bottom disc 222 forms a round top track 228 whereas the space between the bottom disc 222 and the bottom 211 of the base 21 forms a round bottom track 229.

Figure 4:
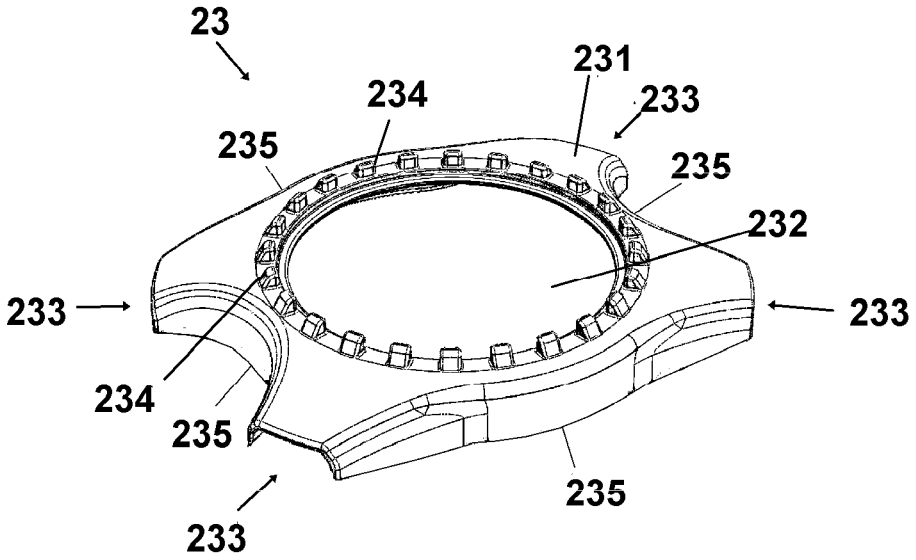
FIG. 4 shows a view of the upper frame component of the device.

FIG. 4 depicts the upper frame 23. The upper frame 23 serves as a top frame component of the mechanism 12. The upper frame 23 is shaped like an open box (whose dimensions preferably correspond with those of the base 21) with a generally flat top surface 231 and a large round hole in its center 232. The upper frame 23 has a sidewall shaped to form four substantially perpendicular sides such that the four corners of the frame are open and serve as openings 233 for the operative communication and engagement of the elastic bands 13 that are integrated into the mechanism 12 (shown in later figures).

The central portion of the sides of the upper frame 23 is convex/concave 235 such that they form a kind of imaginary circle. The reason for this will be evident from the following description of the mechanism in general, and the inner wheel 22 in particular. The upper frame 231 has protrusions 234 around the entire perimeter of the central hole 232.

Figure 5:
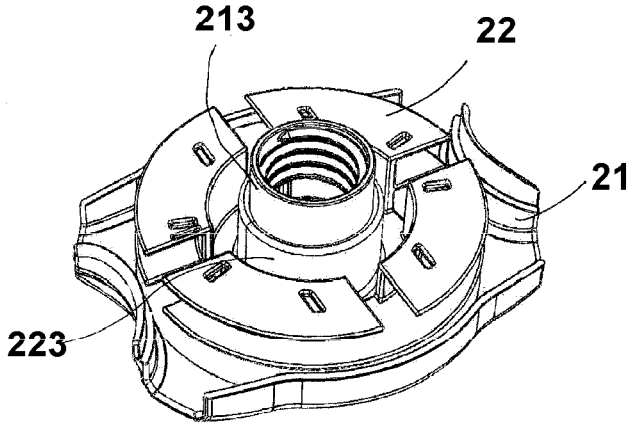
FIG. 5 depicts a view of the inner wheel positioned on the base.

FIG. 5 depicts the preferred means in which the inner wheel 22 is positioned on the base 21. The wheel 22 is positioned on the base 21 such that the hollow, perpendicular cylinder 223 fits over the central cylinder 213. The space between the exterior side of the cylinder 213 and the inner side of the cylinder 223 is very small and restricts the movement of the wheel 22 so that the only movement possible is the rotation of the wheel 22 relative to the base 21.

Figure 6:
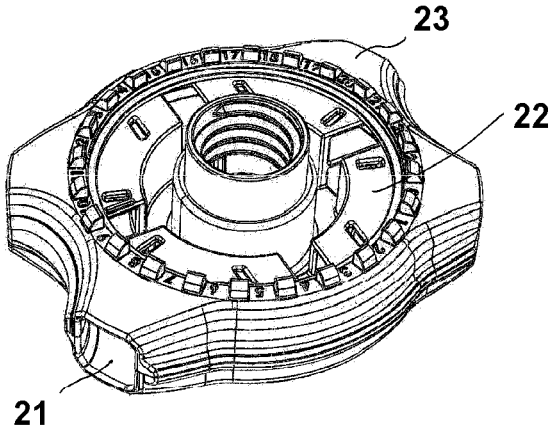
FIG. 6 shows a view of the shortening/lengthening mechanism.

FIG. 6 depicts the assembly of the upper frame 23 in the mechanism 12. The upper frame 23 is positioned on the base 21 and wheel 22 such that the central hole 232 fits over both cylinders 213, 223 and the sides of the upper frame 23 fit over the sides of the base 21, forming a kind of closed box. The four corner openings 212 in the base 21 correspond with the four corner openings 233 of the upper frame, such that four openings are formed at the four comers of the box created when the upper frame 23 covers the base 21.

Figure 7:
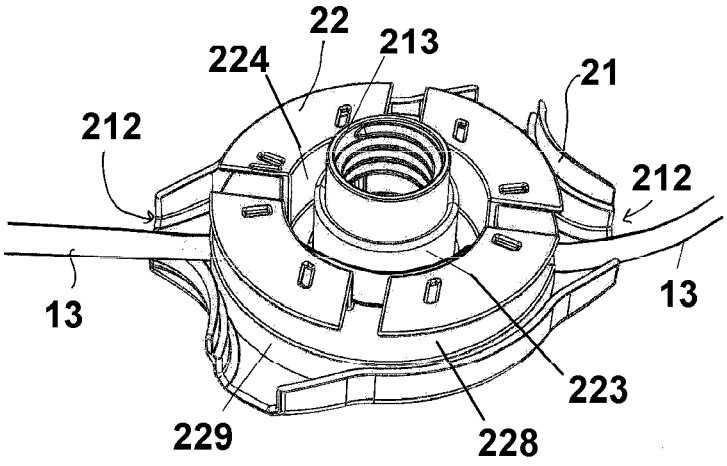
FIG. 7 shows another view of the shortening/lengthening mechanism.
Figure 8:
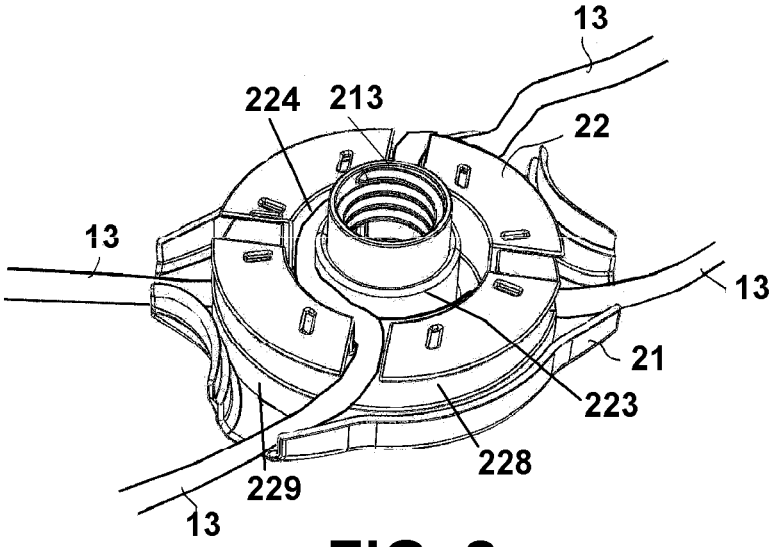
FIG. 8 shows still another view of the shortening/lengthening mechanism with a band in an engaged position.
Figure 9:
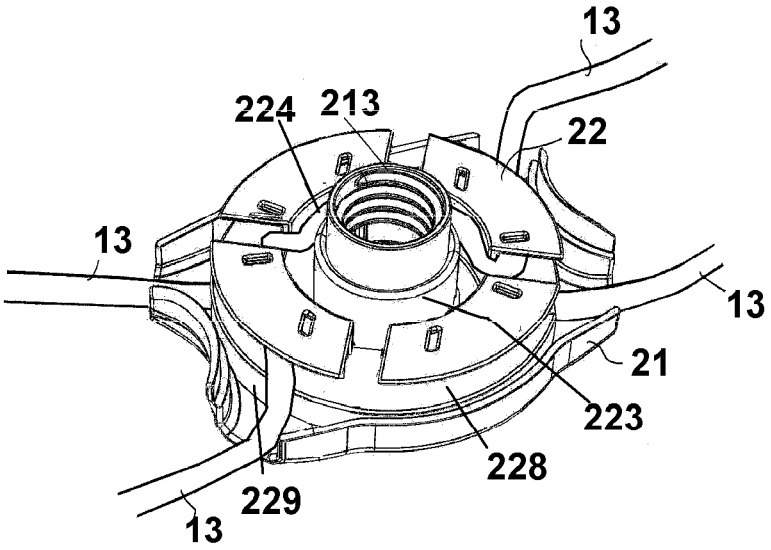
FIG. 9 shows yet another view of the shortening/lengthening mechanism with two bands in an engaged position.

The following figure provides a depiction which to those skilled in the art provides an explanation of the mechanism's preferred means of operation. In FIG. 7 is depicted the mechanism having the base 21 and the inner wheel 22. Also shown are one elastic band 13 that is integrated into the mechanism 12, whereby it communicates through the opening 212 in the base 21, through the top portion of the top circular track 228, through the inner circular track 224, and exiting through the opposite opening 212. FIG. 8 depicts the mechanism 12 after the insertion of another or second elastic band 13 when the device is employed with a plurality of bands 13 rather than configured with a single band 13. FIG. 9 depicts the mechanism 12 with two elastic bands 13 after the inner wheel 22 is rotated relative to the base 21. When the inner wheel 22 is rotated, the elastic bands 13 wrap around the center cylinders and are, in effect, shortened.

Figure 10:
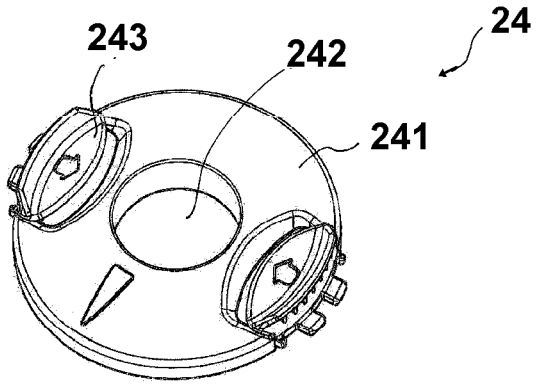
FIG. 10 depicts the cover of the device.
Figure 11:
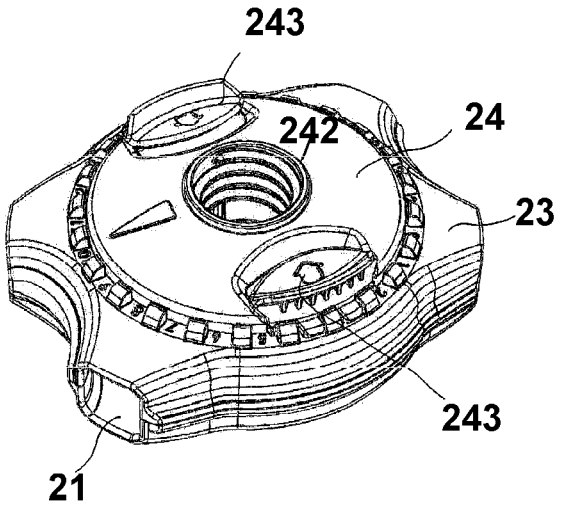
FIG. 11 depicts the shortening/lengthening mechanism with the cover in the engaged position.

FIG. 10 depicts the cover 24. The cover is shown as shaped like a round planar plate 241 with a an aperture defining a hole 242 in the central portion. FIG. 11 depicts the preferred means for operative positioning of the cover 24 with the mechanism 12. The cover 24 is integrated in the mechanism 12 such that the aperture-defined hole 242 fits over the central cylinder 213 of the base 21. The outer perimeter of the cover 24 fits into the central hole 232 of the top frame 23. The cover 24 fits into the inner wheel 22 such that when the cover 24 is rotated, the inner wheel 22 rotates as well. This configuration as shown, and those skilled in the art will perceive, provides a means for shortening the elastic bands 13 as the cover 24 is rotated.

Figure 12:
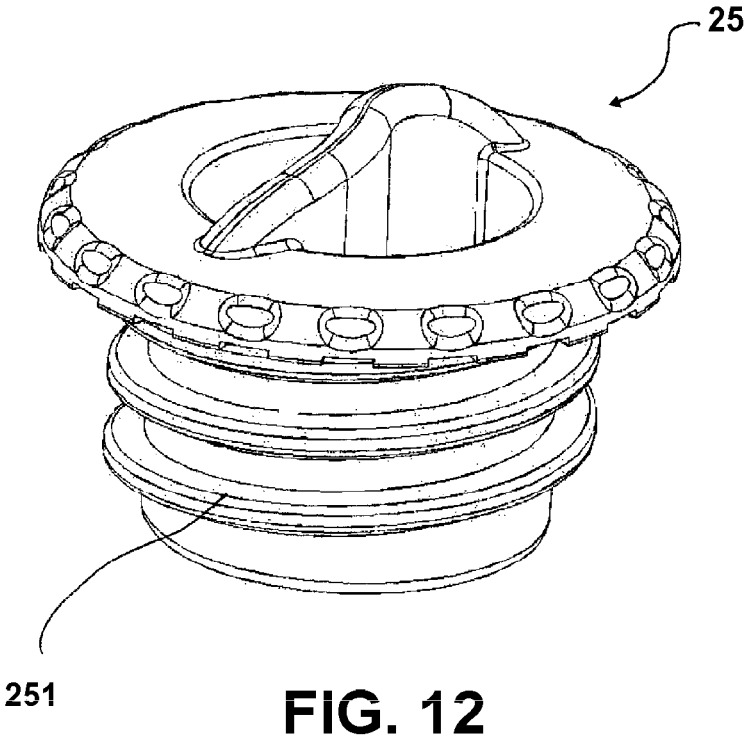
FIG. 12 depicts the tightening screw.

FIG. 12 depicts the tightening screw 25. The tightening screw is shaped like a cylinder with an external thread 251 around its bottom part.

FIGS. 13*a* and 13*b* depict the way the tightening screw 25 is integrated in the mechanism 12. The tightening screw 25 is screwed into the central cylinder 213 of the base 21 such that the thread 251 is screwed onto the cylinder's thread 214. Thus, the tightening screw provides a fastener which provides a means for operatively engaging the depicted parts of the mechanism 12.

The mechanism 12 is constructed as described above, such that the base 21, the upper frame 23 and the tightening screw 25 are joined together. On the other hand, the inner wheel 22 and the cover 24 are joined together by means of pins and/or any other means of operative engagement as would occur to those skilled in the art, such that when the top is rotated, the inner wheel moves relative to the other operatively engaged mechanism components.

The mechanism is equipped with two knobs 243, as depicted in the drawings. The knobs 243 are shown attached to the circumferential edge of the cover. The function of the knobs is to provided means for prevention of accidental and inadvertent rotation of the cover 24 and thus as a means for preventing unintentional shortening or lengthening of the elastic bands.

FIG. 14 depicts the knobs 243 from a view below and also shows two springs 244 attaching the knobs 243 to the cover 24. Pressing the knobs inward provides a means to allow a rotation of the cover 24 relative to the mechanism 12 and thereby allows the user to shorten or lengthen the elastic bands 13. FIG. 15 depicts a knob 243, separate from the mechanism. The mechanism 12 can be attached to the harness 14 using an attaching means 27, such as that as depicted in FIG. 16. The attaching means 27 is shaped like a flat plate that is attached to the harness 14 with a perpendicular cylinder that protrudes from it and is designed so as to fit into the hole of the central cylinder 213 of the base 21.

FIG. 17*a* and FIG. 17*b* depict top and bottom views of the attaching means 27 whereby it is engaged to the mechanism 12 and provides means for an operative engagement to the harness 14 (FIG. 1). The harness 14 is shaped like a vest that is worn over the users's shoulders so that the mechanism is positioned over the users's back. (The harness can be designed, for instance, like standard straps of a firearm's holster.) The elastic band 13 can be a standard elastic exercise band 13 such as rubber rope or other elastic material providing a biasing force to resist stretching of the band. The elastic band 13 is covered with fabric preferably for reasons of safety. As covered the fabric provides a means to maintain the elastic band within the cover such that should the elastic band 13 tear or break, it will not snap back and hit the user. In addition, covering the elastic band 13 with fabric enables it to move freely within the mechanism 12, according to need. Preferably the fabric is knitted to resist raveling if punctured, however woven or spun bonded or film fabrics may also be employed.

Each of the elastic band's ends can and should be equipped with means to form a loop to which a strap may be attached designed to serve as a handle or gripping means (not shown). The device may include one or more elastic bands depending on the user's desire. Further, the gripping means may be any means known to one skilled in the art and is anticipated. The mechanism 12 and the elastic bands 13 can be disconnected from the harness 14 to be used for work-outs in other situations in which the elastic bands 13 are not stretched from the user's back towards his or her chest. Using the device 10 offers the user significant advantages.

Among these advantages is the fact that the user needs only one set of elastic bands and can adjust them for length at will and thus use them in different lengths (which is equivalent to having several elastic bands). In addition, using the device 10, when worn on the back, enables the user to perform work-out movements in many more angles, especially pressing forward, upward, and to the sides and to employ the device to exercise the arms while running or walking and exercising the legs and torso.

FIGS. 18*a*-18*g* depict additional views of the completed assembly of the mechanism 12.

FIG. 19 shows a top view of still yet another mode of the device 10 operatively employing a single elastic band 13 integrated into the mechanism 12, as opposed to two bands 13, shown in previous figures. In this mode, the mechanism 12 is shaped having only two corners that are open and serve as openings 212 for the insertion of elastic bands 13. Those skilled in the art will immediately recognize that the inner wheel 22 need only be slightly modified to accommodate only a single band 13, such as having a single track 228, wherein such modifications are anticipated. Further noting that the means for shortening or lengthening the band 13 will be substantially similar to that of the previous mode of the device 10 disclosed above.

FIG. 20 shows a top view of yet another mode of the device 10 operatively employing three elastic bands 13 integrated into the mechanism 12, as opposed to two bands 13 or single band 13 modes shown in previous figures. In this mode, the mechanism 12 is shaped having six corners, two opposing sets of three corners, that are open and serve as openings 212 for the insertion of the three elastic bands 13 shown in the figure. Those skilled in the art will immediately recognize that the inner wheel 22 need only be slightly modified to accommodate three bands 13, for example, having an upper track 228, lower track 229, and an additional lower track disposed below that, wherein such modifications are anticipated. Further noting that the means for shortening or lengthening the bands 13 will be substantially similar to that of the previous mode of the device 10 disclosed above.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A physical work-out apparatus for a user, comprising;

one or a plurality of elastic bands;

a mechanism, said mechanism comprising a base, an upper frame, and a cover defining an interior cavity;

a wheel rotationally engaged within said interior cavity;

said wheel including a hollow cylinder, two or more horizontal protruding discs, two or more round tracks defined by a circumferential space between said discs;

wherein a portion of said elastic bands is extendable a distance away from said mechanism from a communication along said tracks; and means for adjusting said distance of said portion of said bands whereby a user can either shorten or lengthen said distance of said portion of said bands that extends from said mechanism.

2. The apparatus of claim 1 further comprising;

a harness, said harness configured to allow said mechanism to be removably engaged to said user in a position adjacent with one of said user's back and said user's chest, to an as-used position; and said mechanism in said as-used position providing means to position said extending portions of said elastic bands for operative employment by a stretching with said user's arms;

said mechanism in said as-used position allowing for said stretching concurrent with movement of said user's torso by bending, walking or running, thereby providing means for a concurrent exercise of said user's arms using said bands while bending walking or running.

3. The apparatus of claim 1 wherein said means for adjusting said distance of said portion of said band comprises;

means for rotational engagement of wheel to said base;

whereby rotation of said wheel in a first rotational direction provides a means to wrap said integrated bands about said hollow cylinder thereby drawing said extending portion into said mechanism essentially shortening said extending portion; and whereby rotation of said wheel in a second rotational direction provides a means to unwrap said integrated bands about said hollow cylinder thereby drawing said extending portion out of said mechanism essentially lengthening said extending portion.

4. The apparatus of claim 3 wherein said one or a plurality of elastic bands is one.

5. The apparatus of claim 3 wherein said one or a plurality of elastic bands is two.

6. The apparatus of claim 3 wherein said one or a plurality of elastic bands is three.

7. The apparatus of claim 1 further comprising handles.

8. The apparatus of claim 4 further comprising handles.

9. The apparatus of claim 3 further comprising handles.

10. The apparatus of claim 5 further comprising handles.

11. The apparatus of claim 6 further comprising handles.

* * * * *